US009082536B2

(12) United States Patent
Yang et al.

(10) Patent No.: US 9,082,536 B2
(45) Date of Patent: Jul. 14, 2015

(54) COMMON MODE FILTER

(71) Applicant: SAMSUNG ELECTRO-MECHANICS CO., LTD., Suwon-si, Gyeonggi-do (KR)

(72) Inventors: Ju Hwan Yang, Suwon-si (KR); Geon Se Chang, Suwon-si (KR); Young Do Kweon, Suwon-si (KR); Sung Kwon Wi, Suwon-si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 14 days.

(21) Appl. No.: 14/137,623

(22) Filed: Dec. 20, 2013

(65) Prior Publication Data

US 2014/0176279 A1 Jun. 26, 2014

(30) Foreign Application Priority Data

Dec. 21, 2012 (KR) ..... 10-2012-0150773

(51) Int. Cl.

| | |
|---|---|
| ***H01F 27/29*** | (2006.01) |
| ***H01F 5/04*** | (2006.01) |
| ***H01F 17/04*** | (2006.01) |
| *H01F 17/00* | (2006.01) |

(52) U.S. Cl.

CPC ..... *H01F 5/04* (2013.01); *H01F 17/04* (2013.01); *H01F 27/29* (2013.01); *H01F 2017/0093* (2013.01)

(58) Field of Classification Search

IPC ..... H01F 5/00,27/28, 27/29, 27/30

See application file for complete search history.

(56) References Cited

U.S. PATENT DOCUMENTS

2007/0040163 A1* 2/2007 Okuzawa et al. ..... 257/31
2008/0290977 A1* 11/2008 Ito et al. ..... 336/184

FOREIGN PATENT DOCUMENTS

KR 2007-0076722 A 7/2007

* cited by examiner

*Primary Examiner* — Tuyen Nguyen

(74) *Attorney, Agent, or Firm* — McDermott Will & Emery LLP

(57) ABSTRACT

Disclosed herein is a common mode filter including: a coil part including a conductor coil provided in an insulating part; a plurality of external electrodes provided on the insulating part while being electrically connected to the conductor coil; and a magnetic material part provided in a region between the plurality of external electrodes on the insulating part. By this configuration, impedance characteristics of the common mode filter may be improved.

10 Claims, 8 Drawing Sheets

COMMON MODE FILTER

CROSS REFERENCE(S) TO RELATED APPLICATIONS

This application claims the benefit under 35 U.S.C. Section 119 of Korean Patent Application Serial No. 10-2012-0150773, entitled "Common Mode Filter" filed on Dec. 21, 2012, which is hereby incorporated by reference in its entirety into this application.

BACKGROUND OF THE INVENTION

1. Technical Field

The present invention relates to a common mode filter.

2. Description of the Related Art

Recently, electronic devices such as a cellular phone, a home appliance, a personal computer (PC), a personal digital assistant (PDA), a liquid crystal display (LCD), and the like, have been gradually digitalized and a speed of the electronic devices has gradually increased. Since these electronic devices are sensitive to stimulus from the outside, in the case in which small abnormal voltage and high frequency noise introduced into the electronic devices from the outside into an internal circuit, a circuit may be damaged or a signal may be distorted.

An example of a cause of the above-mentioned abnormal voltage and noise includes lightning, electrostatic discharge charged in a human body, switching voltage generated in the circuit, power noise included in power supply voltage, an unnecessary electromagnetic signal, electromagnetic noise, or the like. As a unit for preventing the above-mentioned abnormal voltage and high frequency noise from being introduced into the circuit, a common mode filter has been used.

A general structure of a common mode filter according to the related art will be described with reference to Patent Document 1. The common mode filter according to the related art has a structure in which a pair of conductor coils magnetically coupled to each other is formed on a magnetic substrate and is enclosed by an insulating resin. That is, the common mode filter has a structure in which the magnetic substrate and an insulating layer are stacked in view of an appearance.

However, in the general common mode filter according to the related art as disclosed in Patent Document 1, since a primary coil and a secondary coil are formed on different layers, there is a limitation in slimming the common mode filter.

In addition, since one ends of the primary and secondary coils are positioned at the center of a winding region, a lead wire should be provided on a separate layer in order to connect one ends of the first and secondary coils to external electrodes. Therefore, it is difficult to slim the common mode filter, and parasitic capacitance is generated between the lead wire and the coils to deteriorate performance of the common mode filter.

RELATED ART DOCUMENT

Patent Document (Patent Document 1) Korean Patent Laid-Open Publication No. 10-2007-0076722

SUMMARY OF THE INVENTION

An object of the present invention is to provide a common mode filter capable of maximizing impedance characteristics and being further slimmed as compared with the related art.

According to an exemplary embodiment of the present invention, there is provided a common mode filter including: a substrate; a coil part including an insulating part provided on the substrate and a conductor coil provided in the insulating part; a plurality of external electrodes provided on the insulating part while being electrically connected to the conductor coil; and a magnetic material part provided in a region between the plurality of external electrodes on the insulating part, wherein each of the plurality of external electrodes has a length of a short side of a transversal cross section corresponding to a half or less of a height thereof.

The conductor coil may be formed by winding a conductive material at least once on one layer.

The coil part may further include an outer terminal connected to one end of the conductor coil and an inner terminal connected to the other end of the conductor coil, and at least some of the plurality of external electrodes may be directly connected to the outer terminal.

The common mode filter may further include a plurality of external terminals each covering at least some of the plurality of external electrodes.

The common mode filter may further include a cover part made of an insulating material and covering portions of the external electrodes exposed to the outside of the plurality of external terminals.

According to another exemplary embodiment of the present invention, there is provided a common mode filter including: a substrate; a first insulating part provided on the substrate; primary and secondary coils each formed by winding a conductive material at least once on the first insulating part; a first primary outer terminal provided at one end of the primary coil; a primary inner terminal provided at the other end of the primary coil; a first secondary outer terminal provided at one end of the secondary coil; a secondary inner terminal provided at the other end of the secondary coil; a second insulating part formed on the first insulating part and covering the primary coil, the secondary coil, the primary inner terminal, and the secondary inner terminal; a first primary external electrode provided on the first primary outer terminal to thereby be electrically connected to the first primary outer terminal; a second primary external electrode electrically connected to the primary inner terminal; a first secondary external electrode provided on the first secondary outer terminal to thereby be electrically connected to the first secondary outer terminal; a second secondary external electrode electrically connected to the secondary inner terminal; and a magnetic material part provided in a region between the first primary external electrode, the second primary external electrode, the first secondary external electrode, and the second secondary external electrode, wherein at least one of the first primary external electrode, the second primary external electrode, the first secondary external electrode, and the second secondary external electrode has a length of a short side of a transversal cross section corresponding to a half or less of a height thereof.

The common mode filter may further include: a first via having one surface contacting the primary inner terminal and the other surface contacting the second primary external electrode while penetrating through the second insulating part; and a second via having one surface contacting the secondary inner terminal and the other surface contacting the second secondary external electrode while penetrating through the second insulating part.

The second primary external electrode may include: a primary lead electrode contacting the first via; and a second primary connection electrode formed to be symmetrical to the first primary external electrode and contacting the primary lead electrode, and the secondary external electrode may include: a secondary lead electrode contacting the second via; and a second secondary connection electrode formed to be symmetrical to the first secondary external electrode and contacting the second lead electrode.

The common mode filter may further include a plurality of external terminals provided on the magnetic material part and each covering at least some of the first primary external electrode, the second primary external electrode, the first secondary external electrode, and the second secondary external electrode.

The common mode filter may further include a cover part covering portions of the primary lead electrode and the secondary lead electrode exposed to the outside of the plurality of external terminals.

DESCRIPTION OF THE PREFERRED EMBODIMENTS

Figure 1:
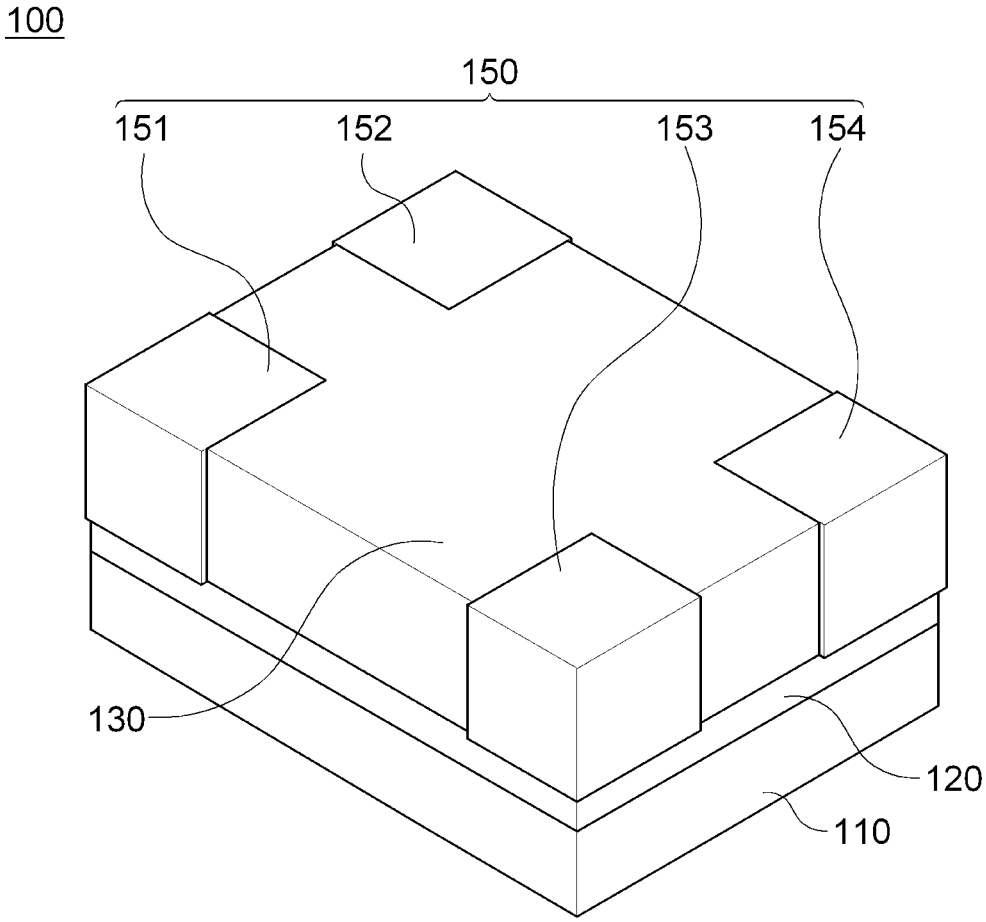
FIG. 1 is a perspective view schematically showing a common mode filter according to an exemplary embodiment of the present invention.

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art. Like reference numerals throughout the description denote like elements.

Terms used in the present specification are for explaining exemplary embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

For simplification and clearness of illustration, a general configuration scheme will be shown in the accompanying drawings, and a detailed description of the feature and the technology well known in the art will be omitted in order to prevent a discussion of exemplary embodiments of the present invention from being unnecessarily obscure. Additionally, components shown in the accompanying drawings are not necessarily shown to scale. For example, sizes of some components shown in the accompanying drawings may be exaggerated as compared with other components in order to assist in understanding of exemplary embodiments of the present invention. Like reference numerals on different drawings will denote like components, and similar reference numerals on different drawings will denote similar components, but are not necessarily limited thereto.

In the specification and the claims, terms such as "first", "second", "third", "fourth" and the like, if any, will be used to distinguish similar components from each other and be used to describe a specific sequence or a generation sequence, but is not necessarily limited thereto. It may be understood that these terms are compatible with each other under an appropriate environment so that exemplary embodiments of the present invention to be described below may be operated in a sequence different from a sequence shown or described herein. Likewise, in the present specification, in the case in which it is described that a method includes a series of steps, a sequence of these steps suggested herein is not necessarily a sequence in which these steps may be executed. That is, any described step may be omitted and/or any other step that is not described herein may be added to the method.

In the specification and the claims, terms such as "left", "right", "front", "rear", "top, "bottom", "over", "under", and the like, if any, do not necessarily indicate relative positions that are not changed, but are used for description. It may be understood that these terms are compatible with each other under an appropriate environment so that exemplary embodiments of the present invention to be described below may be operated in a direction different from a direction shown or described herein. A term "connected" used herein is defined as being directly or indirectly connected in an electrical or non-electrical scheme. Targets described as being "adjacent to" each other may physically contact each other, be close to each other, or be in the same general range or region, in the context in which the above phrase is used. Here, a phrase "in an exemplary embodiment" means the same exemplary embodiment, but is not necessarily limited thereto.

Hereinafter, a configuration and an acting effect of exemplary embodiments of the present invention will be described in more detail with reference to the accompanying drawings.

Figure 2:
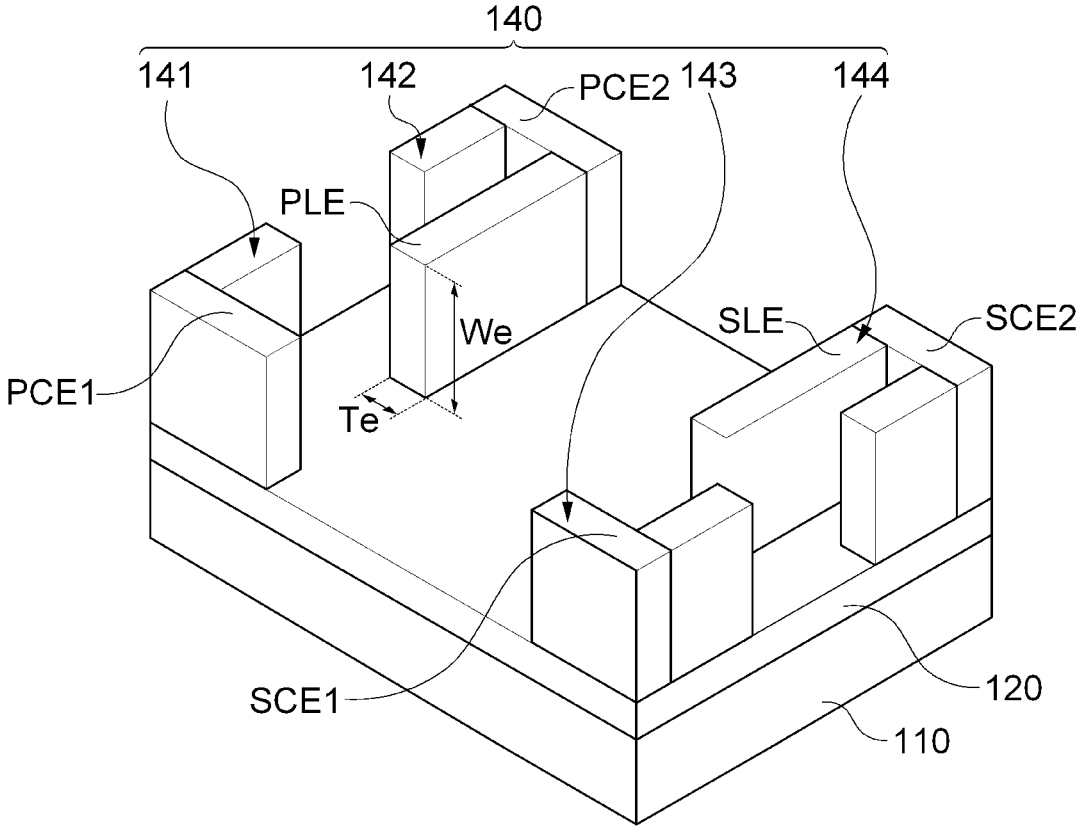
FIG. 2 is a perspective view schematically showing a state in which an external terminal and a magnetic material part are removed in FIG. 1.

FIG. 1 is a perspective view schematically showing a common mode filter 100 according to an exemplary embodiment of the present invention; and FIG. 2 is a perspective view schematically showing a state in which an external terminal 150 and a magnetic material part 130 are removed in FIG. 1.

Referring to FIGS. 1 and 2, the common mode filter 100 according to the exemplary embodiment of the present invention may be configured to include a substrate 110, a coil part 120, external electrodes 140, and a magnetic material.

The substrate 110 may be a magnetic substrate 110 made of a magnetic material.

Here, in the case in which a content of magnetic material is high, a passivation layer may be provided in order to improve an insulation property.

The coil part 120 may include a conductor coil 125 provided in an insulating part 124.

The external electrode 140 may be electrically connected to the conductor coil 125 and serve to electrically connect the conductor coil 125 to another device when the common mode filter 100 is mounted on or coupled to another device. In addition, a plurality of external electrodes 140 may be provided while being insulated from each other. That is, the external electrodes 140 may include a first primary external electrode 141, a second primary external electrode 142, a first secondary external electrode 143, and a second secondary external electrode 144.

The magnetic material part 130 is provided between the external electrodes 140 on the insulating part 124. In the common mode filter 100 according to the exemplary embodiment of the present invention, a structure capable of maximizing a volume of the magnetic material part 130 is used in order to improve impedance characteristics.

That is, the external electrode 140 provided on the insulating part 124 is formed so that a length Te of a short side of a transversal cross section is shorter than a height We thereof. Therefore, when it is assumed that sizes of the common mode filters 100 are the same as each other, the volume of the magnetic material part 130 provided between the external electrodes 140 may be maximized.

In other words, the external electrode 140 is formed in a shape in which a width Te thereof is narrower than the height We thereof. Particularly, the length Te of the short side of the transversal cross section of the external electrode 140 is a half or less of the height We thereof.

Therefore, the external electrode 140 of the common mode filter 100 according to the exemplary embodiment of the present invention may be considered as being substantially formed in a panel shape.

Figure 3A:
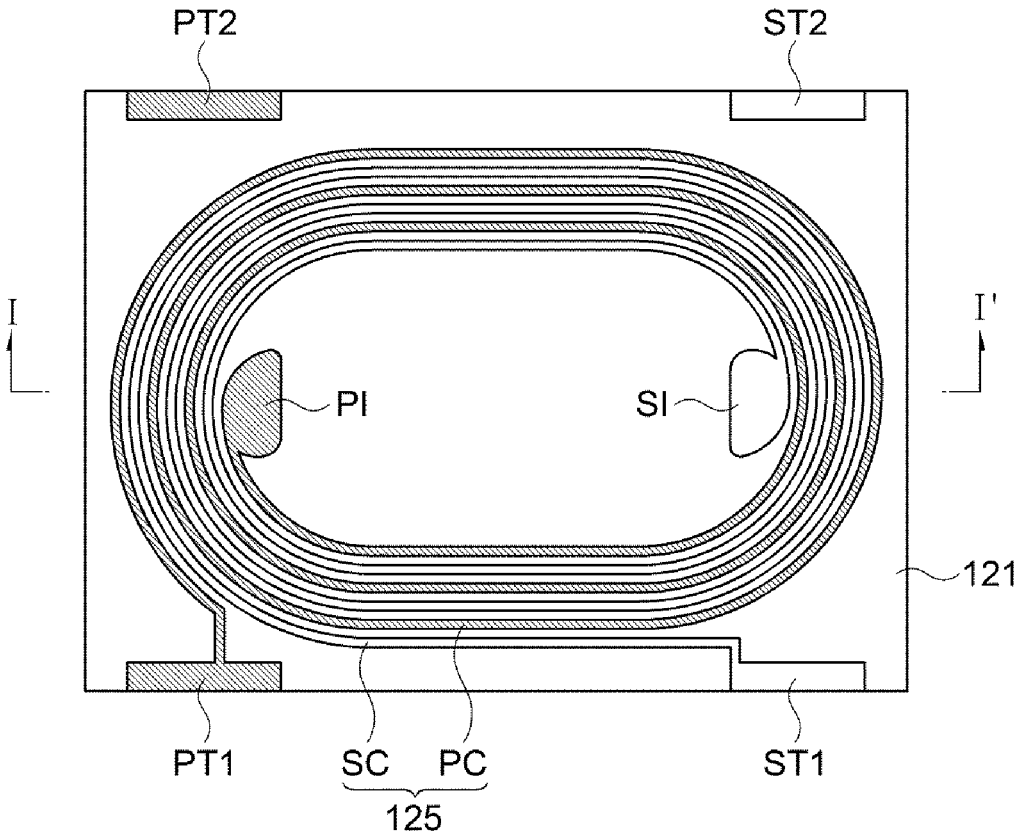
FIG. 3A is a plan view schematically showing a state in which a conductor pattern is formed.
Figure 4A:
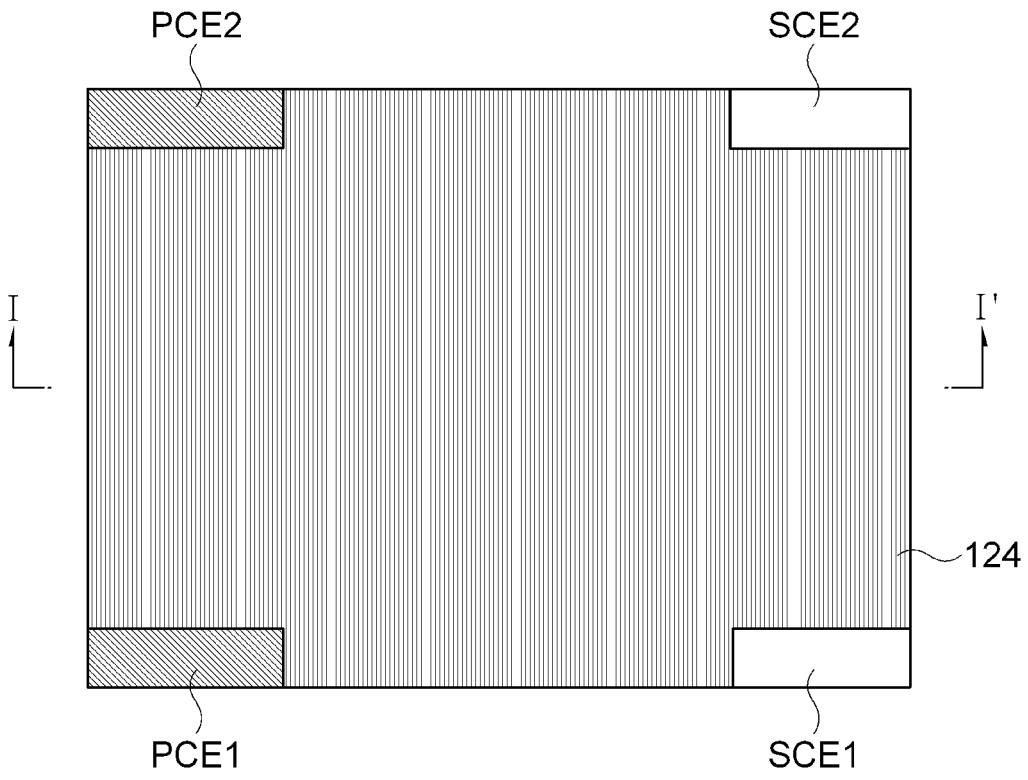
FIG. 4A is a plan view schematically showing a state in which an insulating part and a connection electrode are formed.
Figure 5A:
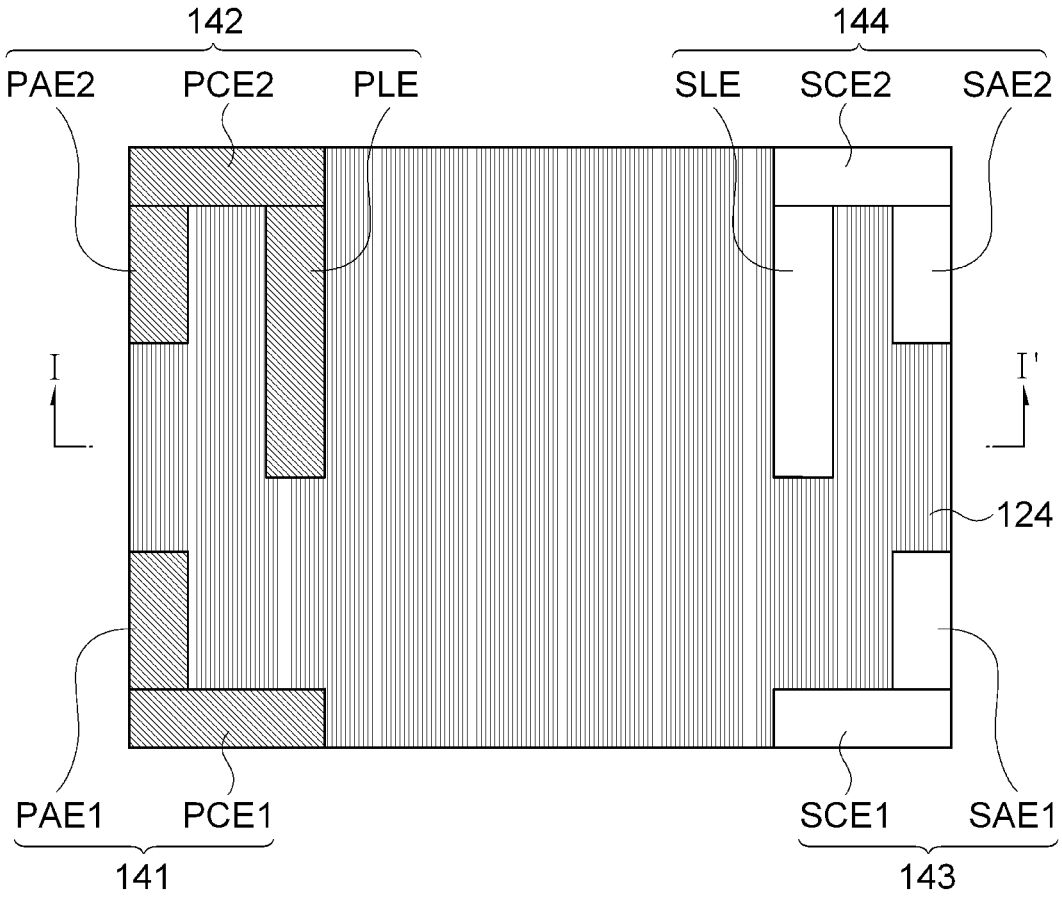
FIG. 5A is a plan view schematically showing a state in which an external electrode is formed.
Figure 6A:
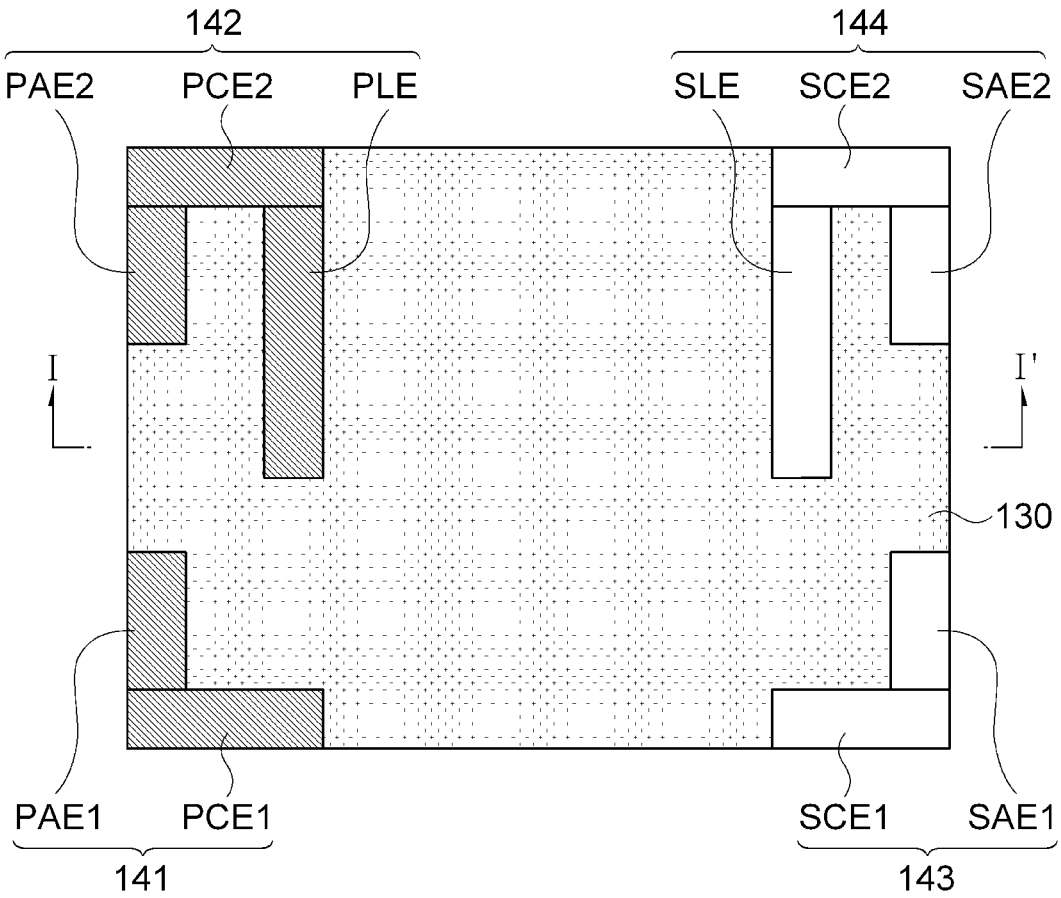
FIG. 6A is a plan view schematically showing a state in which a magnetic material part is formed.

FIG. 3A is a plan view schematically showing a state in which a conductor pattern is formed; FIG. 4A is a plan view schematically showing a state in which an insulating part 124 and a connection electrode are formed; FIG. 5A is a plan view schematically showing a state in which an external electrode 140 is formed; and FIG. 6A is a plan view schematically showing a state in which a magnetic material part 130 is formed.

In addition, FIGS. 3B, 4B, 5B, and 6B are, respectively, cross-sectional views taken along the line I-I' of FIGS. 3A, 4A, 5A, and 6A.

Hereinafter, a detailed configuration of the common mode filter 100 according to the exemplary embodiment of the present invention will be described in more detail with reference to FIGS. 3A to 6B.

Figure 3B:
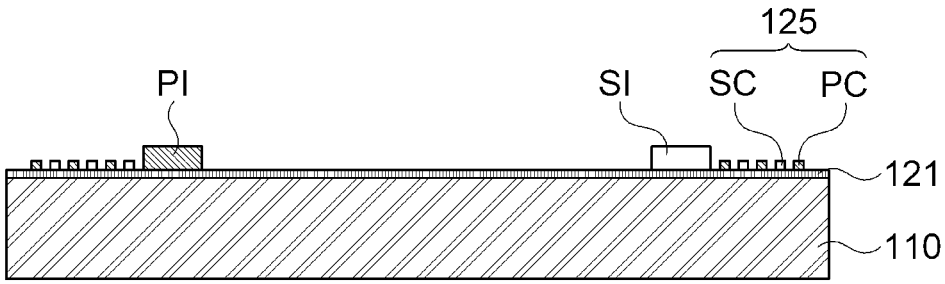
FIG. 3B is a cross-sectional view taken along the line I-I' of FIG. 3A.

First, referring to FIGS. 3A and 3B, the conductor coil 125 may include a primary coil PC and a secondary coil SC, wherein the primary coil PC may have one end connected to a first primary outer terminal PT1 and the other end connected to a primary inner terminal PI, and secondary coil SC may have one end connected to a first secondary outer terminal ST1 and the other end connected a secondary inner terminal SI.

Here, the primary coil PC and the secondary coil SC may be wound at least once together with each other on the same layer while maintaining an interval capable of securing an insulation property therebetween.

The conductor coil 125 is formed on an upper surface of a first insulating part 121 disposed on a surface of the substrate 110, thereby making it possible to prevent a short circuit phenomenon due to a magnetic material included in the substrate 110.

Figure 4B:
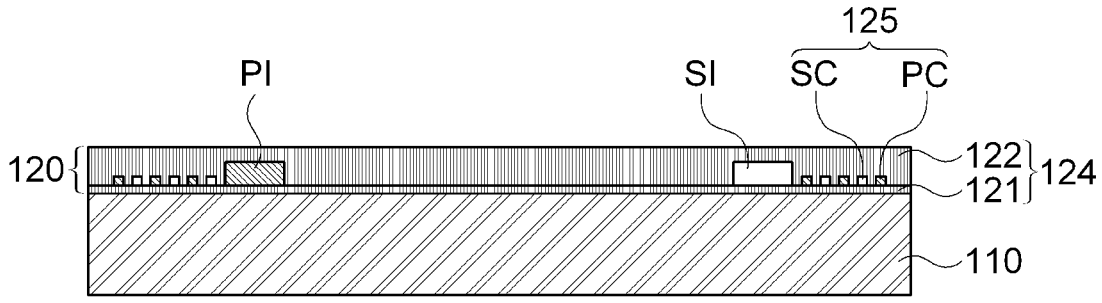
FIG. 4B is a cross-sectional view taken along the line I-I' of FIG. 4A.

In addition, as shown in FIGS. 4A and 4B, a second insulating part 122 covering the conductor coil 125 and the first insulating part 121 may be further provided on the first insulating part 121 to configure the insulating part 124 together with the first insulating part 121.

Therefore, the conductor coil 125 may be included in the insulating part 124.

In addition, an inner portion of the insulating part 124 may be further provided with a second primary outer terminal PT2 and a second secondary outer terminal ST2, which may be electrically connected to the conductor coil 125 by a primary lead terminal and a second lead terminal to be described below.

Meanwhile, a first primary connection electrode PCE1, a second primary connection electrode PCE2, a first secondary connection electrode SCE1, and a second secondary connection electrode SCE2 may be provided on the second insulating part 122.

Here, the first primary connection electrode PCE1 may be provided on the first primary outer terminal PT1 to thereby be directly connected to the first primary outer terminal PT1, and the second primary connection electrode PCE2 may be provided on the second primary outer terminal PT2 to thereby be directly connected to the second primary outer terminal PT2. In addition, the first secondary connection electrode SCE1 may be provided on the first secondary outer terminal ST1 to thereby be directly connected to the first secondary outer terminal ST1, and the second secondary connection electrode SCE2 may be provided on the second secondary outer terminal ST2 to thereby be directly connected to the second secondary outer terminal ST2.

Further, the first primary connection electrode PCE1 to the second secondary connection electrode SCE2 may be connected to the first primary outer terminal PT1 to the second secondary outer terminal ST2 by vias (not shown), or the like, respectively.

Figure 5B:
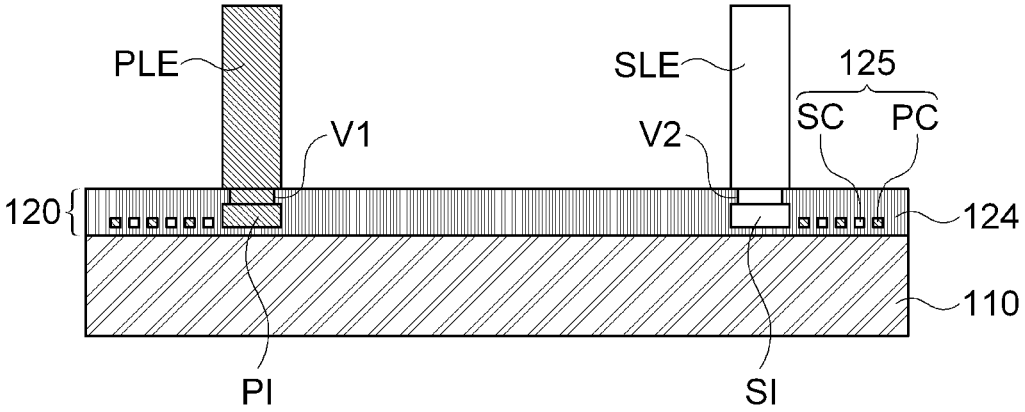
FIG. 5B is a cross-sectional view taken along the line I-I' of FIG. 5A.

Next, referring to FIGS. 5A and 5B, a primary lead electrode PLE having one end connected to the second primary connection electrode PCE2 and a second lead electrode SLE having one end connected to the second secondary electrode SCE2 may be provided on an upper surface of the second insulating surface 122. Here, the other end of the primary lead electrode PLE may be formed toward the first primary connection electrode PCE1 so as to reach up to an upper portion of the primary inner terminal PI, and the primary lead electrode PLE and the primary inner terminal PI may be electrically connected to each other by a first via V1 penetrating through the second insulating part 122.

In addition, the other end of the second lead electrode SLE may be formed toward the first secondary connection electrode SCE1 so as to reach up to an upper portion of the second inner terminal SI, and the secondary lead electrode SLE and the secondary inner terminal SI may be electrically connected to each other by a second via V2 penetrating through the second insulating part 122.

As described above, the primary lead electrode PLE and the secondary lead electrode SLE may be provided and also serve as a lead wire on a layer on which the external electrodes 140 are formed, such that a layer for a lead wire according to the related art needs not to be added. Therefore, a problem due to parasitic capacitance may be alleviated, and it may be easy to slim the common mode filter 100.

Meanwhile, a first primary additional electrode PAE1 to a second secondary additional electrode SAE2 may be connected to the first primary connection electrode PCE1 to the second secondary connection electrode SCE2, respectively, to improve connectivity with external terminals 150 to be described below.

In addition, both of the first primary connection electrode PCE1 and the first primary additional electrode PAE1 may be collectively called a first primary external electrode 141, all of the second primary connection electrode PCE2, the first lead electrode PLE, and the second primary additional electrode PAE2 may be collectively called a second primary external electrode 142, both of the first secondary connection electrode SCE1 and the first secondary additional electrode SAE1 may be collectively called a first secondary external electrode 143, and all of the second secondary connection electrode SCE2, the secondary lead electrode SLE, and the second secondary additional electrode SAE2 may be collectively called a second secondary external electrode 144.

Figure 6B:
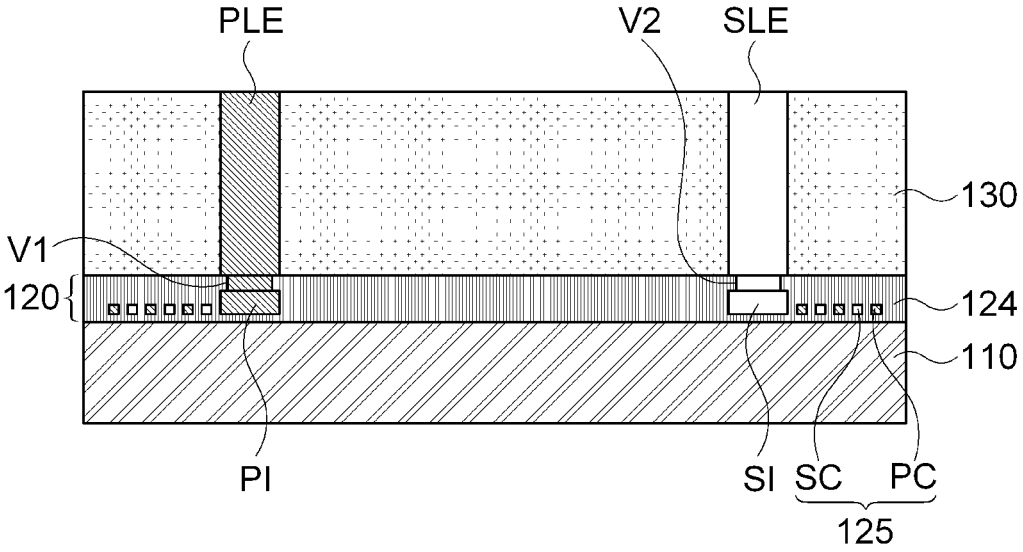
FIG. 6B is a cross-sectional view taken along the line I-I' of FIG. 6A.

Next, referring to FIGS. 6A and 6B, the magnetic material part 130 filled in a region between the external electrodes 140 may be formed on the insulating part 124.

As described above, in the common mode filter 100 according to the exemplary embodiment of the present invention, since the external electrodes 140 are substantially formed in a panel shape, a volume of the magnetic material part 130 may be relatively increased as compared with the common mode filter 100 according to the related art having the same size as that of the common mode filter 100 according to the exemplary embodiment of the present invention.

Therefore, impedance characteristics of the common mode filter 100 according to the exemplary embodiment of the present invention may be improved as compared with the related art.

Figure 7A:
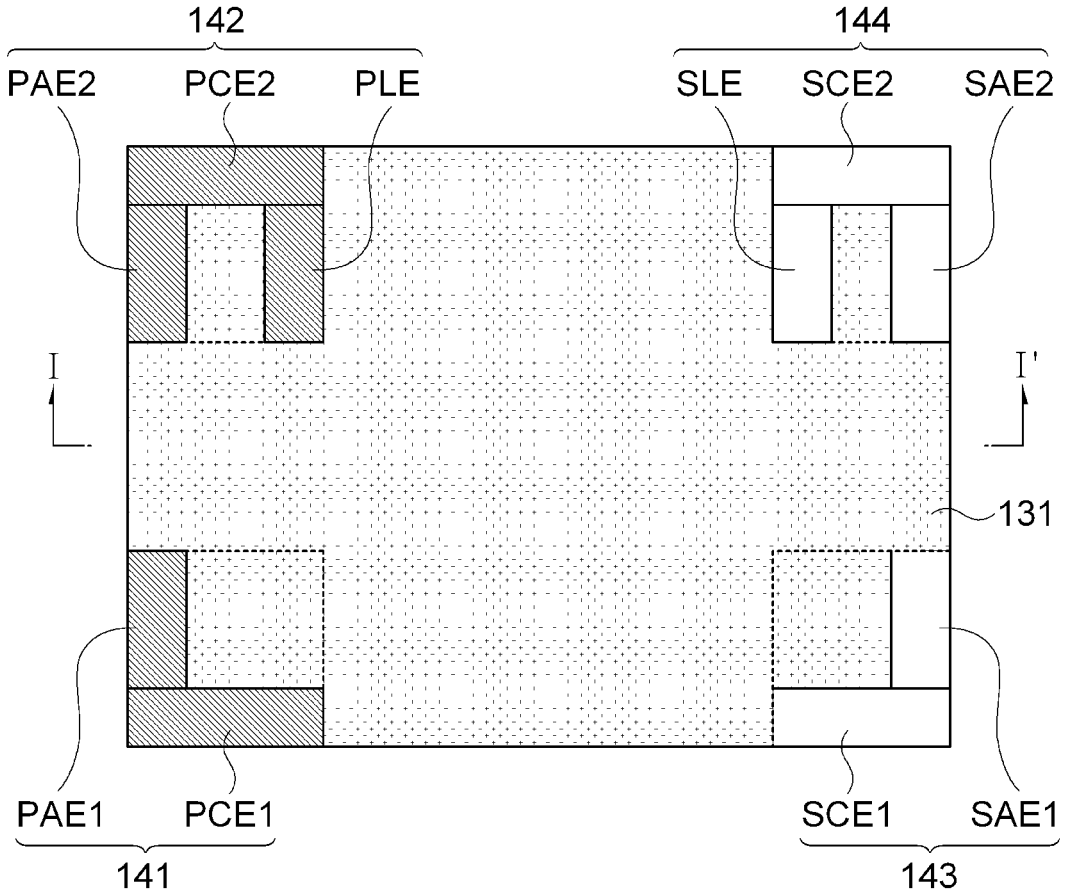
FIG. 7A is a plan view schematically showing a state in which a cover part is formed.
Figure 7B:
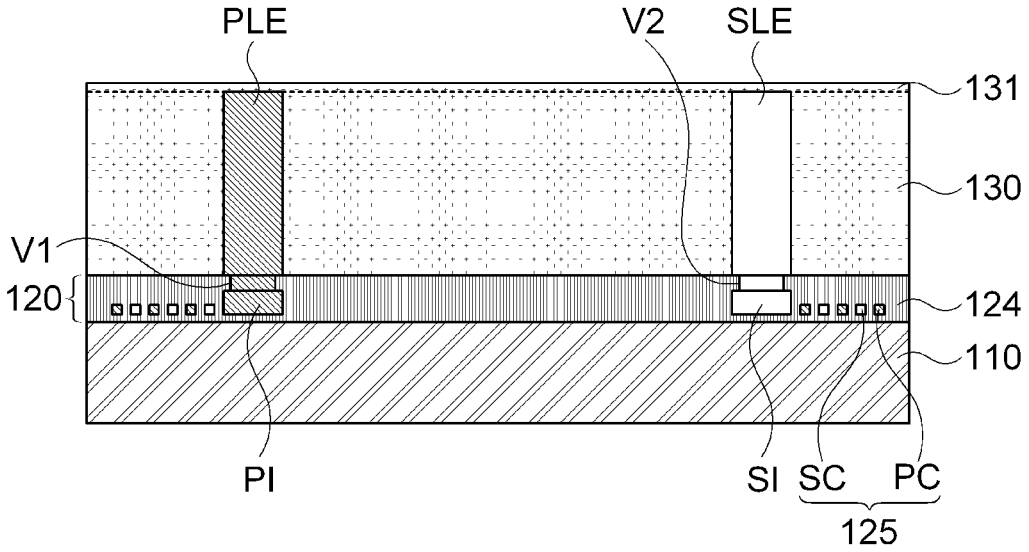
FIG. 7B is a cross-sectional view taken along the line I-I' of FIG. 7A.

FIG. 7A is a plan view schematically showing a state in which a cover part 131 is formed; FIG. 7B is a cross-sectional view taken along the line I-I' of FIG. 7A; and FIG. 8 is a plan view schematically showing a state in which an external terminal 150 is formed.

Figure 8:
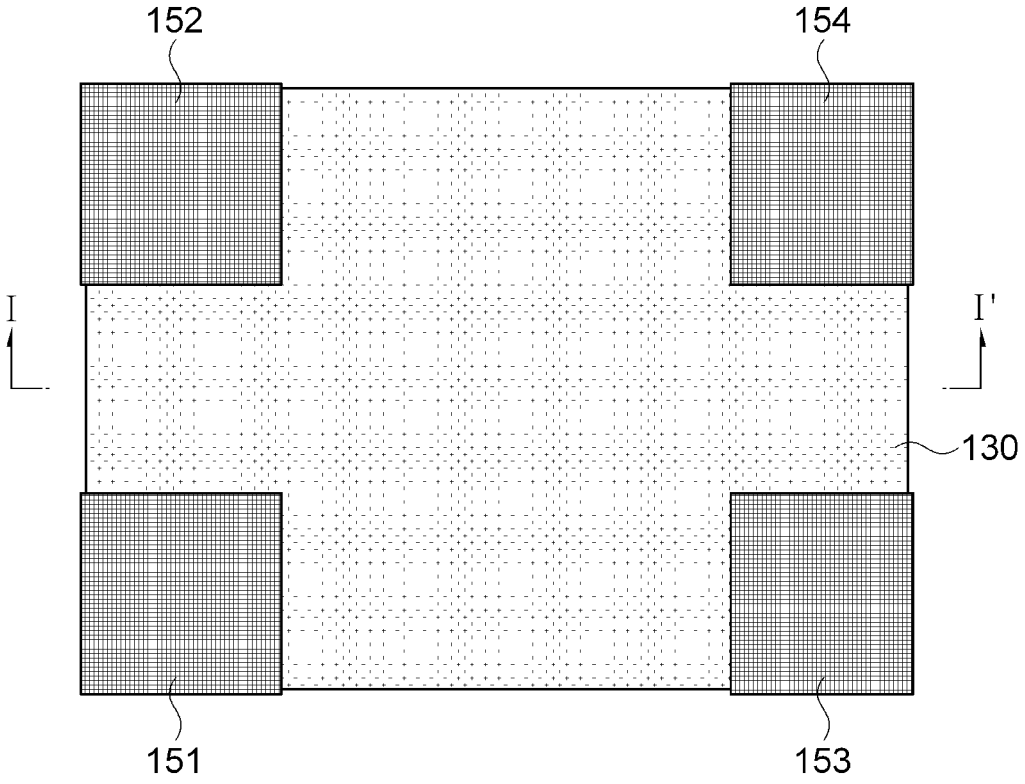
FIG. 8 is a plan view schematically showing a state in which an external terminal is formed.

Referring to FIGS. 7A to 8, the common mode filter 100 according to the exemplary embodiment of the present invention may further include a plurality of external electrodes 150 covering first to fourth external electrodes 140, respectively. Here, the external terminals 150 may include a first external terminal 151 covering the first external electrode 140, a second external terminal 152 covering the second external electrode 140, a third external terminal 153 covering the third external electrode 140, and a fourth external terminal 154 covering the fourth external electrode 140.

In addition, the primary lead electrode PLE and the secondary lead electrode SLE may be formed to have a length longer than those of other electrodes. Therefore, in the primary lead electrode PLE and the secondary lead electrode SLE, portions that are not covered by the external terminals 150 may be generated.

When the common mode filter 100 is coupled to another device, the external terminals 150 may be applied with solder pastes, which may be short-circuited by exposed portions of a primary external terminal 150 and a secondary external terminal 150.

In order to prevent this problem, the common mode filter 100 according to the exemplary embodiment of the present invention may further include a cover part 131 covering the exposed portions of the primary external terminal 150 and the secondary external terminal 150 and made of an insulating material.

Here, the cover part 131 is made of a magnetic material, thereby making it possible to contribute to improvement of impedance characteristics of the common mode filter 100.

According to the exemplary embodiments of the present invention configured as described above, the impedance characteristics of the common mode filter may be improved.

In addition, the parasitic capacitance problem may be decreased without a separate lead wire, and it may be easy to slim the common mode filter.

What is claimed is:

1. A common mode filter comprising:

a substrate;

a coil part including an insulating part provided on the substrate and a conductor coil provided in the insulating part;

a plurality of external electrodes provided on the insulating part while being electrically connected to the conductor coil; and a magnetic material part provided in a region between the plurality of external electrodes on the insulating part, wherein each of the plurality of external electrodes has a length of a short side of a transversal cross section corresponding to a half or less of a height thereof.

2. The common mode filter according to claim 1, wherein the conductor coil is formed by winding a conductive material at least once on one layer.

3. The common mode filter according to claim 2, wherein the coil part further includes an outer terminal connected to one end of the conductor coil and an inner terminal connected to the other end of the conductor coil, and at least some of the plurality of external electrodes are directly connected to the outer terminal.

4. The common mode filter according to claim 3, further comprising a plurality of external terminals each covering at least some of the plurality of external electrodes.

5. The common mode filter according to claim 4, further comprising a cover part made of an insulating material and covering portions of the external electrodes exposed to the outside of the plurality of external terminals.

6. A common mode filter comprising:

a substrate;

a first insulating part provided on the substrate;

primary and secondary coils each formed by winding a conductive material at least once on the first insulating part;

a first primary outer terminal provided at one end of the primary coil;

a primary inner terminal provided at the other end of the primary coil;

a first secondary outer terminal provided at one end of the secondary coil;

a secondary inner terminal provided at the other end of the secondary coil;

a second insulating part formed on the first insulating part and covering the primary coil, the secondary coil, the primary inner terminal, and the secondary inner terminal;

a first primary external electrode provided on the first primary outer terminal to thereby be electrically connected to the first primary outer terminal;

a second primary external electrode electrically connected to the primary inner terminal;

a first secondary external electrode provided on the first secondary outer terminal to thereby be electrically connected to the first secondary outer terminal;

a second secondary external electrode electrically connected to the secondary inner terminal; and a magnetic material part provided in a region between the first primary external electrode, the second primary external electrode, the first secondary external electrode, and the second secondary external electrode, wherein at least one of the first primary external electrode, the second primary external electrode, the first secondary external electrode, and the second secondary external electrode has a length of a short side of a transversal cross section corresponding to a half or less of a height thereof.

7. The common mode filter according to claim 6, further comprising:

a first via having one surface contacting the primary inner terminal and the other surface contacting the second primary external electrode while penetrating through the second insulating part; and a second via having one surface contacting the secondary inner terminal and the other surface contacting the second secondary external electrode while penetrating through the second insulating part.

8. The common mode filter according to claim 7, wherein the second primary external electrode includes:

a primary lead electrode contacting the first via; and a second primary connection electrode formed to be symmetrical to the first primary external electrode and contacting the primary lead electrode, and the secondary external electrode includes:

a secondary lead electrode contacting the second via; and a second secondary connection electrode formed to be symmetrical to the first secondary external electrode and contacting the second lead electrode.

9. The common mode filter according to claim 8, further comprising a plurality of external terminals provided on the magnetic material part and each covering at least some of the first primary external electrode, the second primary external electrode, the first secondary external electrode, and the second secondary external electrode.

10. The common mode filter according to claim 9, further comprising a cover part covering portions of the primary lead electrode and the secondary lead electrode exposed to the outside of the plurality of external terminals.

* * * * *